US006971919B1

(12) United States Patent
Huang

(10) Patent No.: US 6,971,919 B1
(45) Date of Patent: Dec. 6, 2005

(54) MEMORY CARD CONNECTOR

(76) Inventor: Huang-Chou Huang, No. 377, Fu-Teh First Rd, Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/052,972

(22) Filed: Feb. 7, 2005

(51) Int. Cl.[7] ..... H01R 24/00
(52) U.S. Cl. ..... 439/630; 439/331
(58) Field of Search ..... 439/629, 630, 439/330, 331, 260, 525

(56) References Cited

U.S. PATENT DOCUMENTS 6,383,027 B2 * 5/2002 Cabane et al. ..... 439/630
6,623,304 B2 * 9/2003 Harasawa et al. ..... 439/630
6,743,035 B1 * 6/2004 Yang ..... 439/326
6,881,086 B2 * 4/2005 Ohashi ..... 439/326
6,890,203 B2 * 5/2005 Matsunaga et al. ..... 439/331
2002/0052147 A1 * 5/2002 Sato ..... 439/630

* cited by examiner

*Primary Examiner*—Hien Vu
(74) *Attorney, Agent, or Firm*—Dellett & Walters

(57) ABSTRACT

A memory card connector includes a U-like body formed with a central portion and two arms. A cover has a free end pivotally mounted on one of the arms, and an upright portion of the cover can be fastened on the other arm of the body after a memory card is received in the body. Whereby, the memory card connector is a pivot-type structure to adapt to some digital peripheral equipment with special designs.

4 Claims, 5 Drawing Sheets

MEMORY CARD CONNECTOR

BACKGROUND OF THE INVENTION

1. Field of the Invention

The present invention relates to a memory card connector adapted to digital peripheral equipment, and more particularly to a memory card connector with a pivotal cover.

2. Description of Related Art

Memory cards are generally used as storage media for digital peripheral equipment, such as digital cameras, PDAs, mobile phones etc. The digital peripheral equipment is provided with a memory card connector for receiving the memory cards therein.

Conventional memory card connectors are generally an insertion type that includes an enclosure and an opening defined at a side of and communicating with the enclosure. The memory card is inserted through the opening to position in the enclosure. However, because various types of digital peripheral equipment are designed with differing structures, the conventional insertion type memory card connector may be not suitable for some digital peripheral equipment with special structures.

Therefore, the invention provides a memory card connector to mitigate or obviate the aforementioned problems.

SUMMARY OF THF INVENTION

The main objective of the present invention is to provide a memory card connector which has a pivotal cover to adapt to receive memory cards with special structures.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
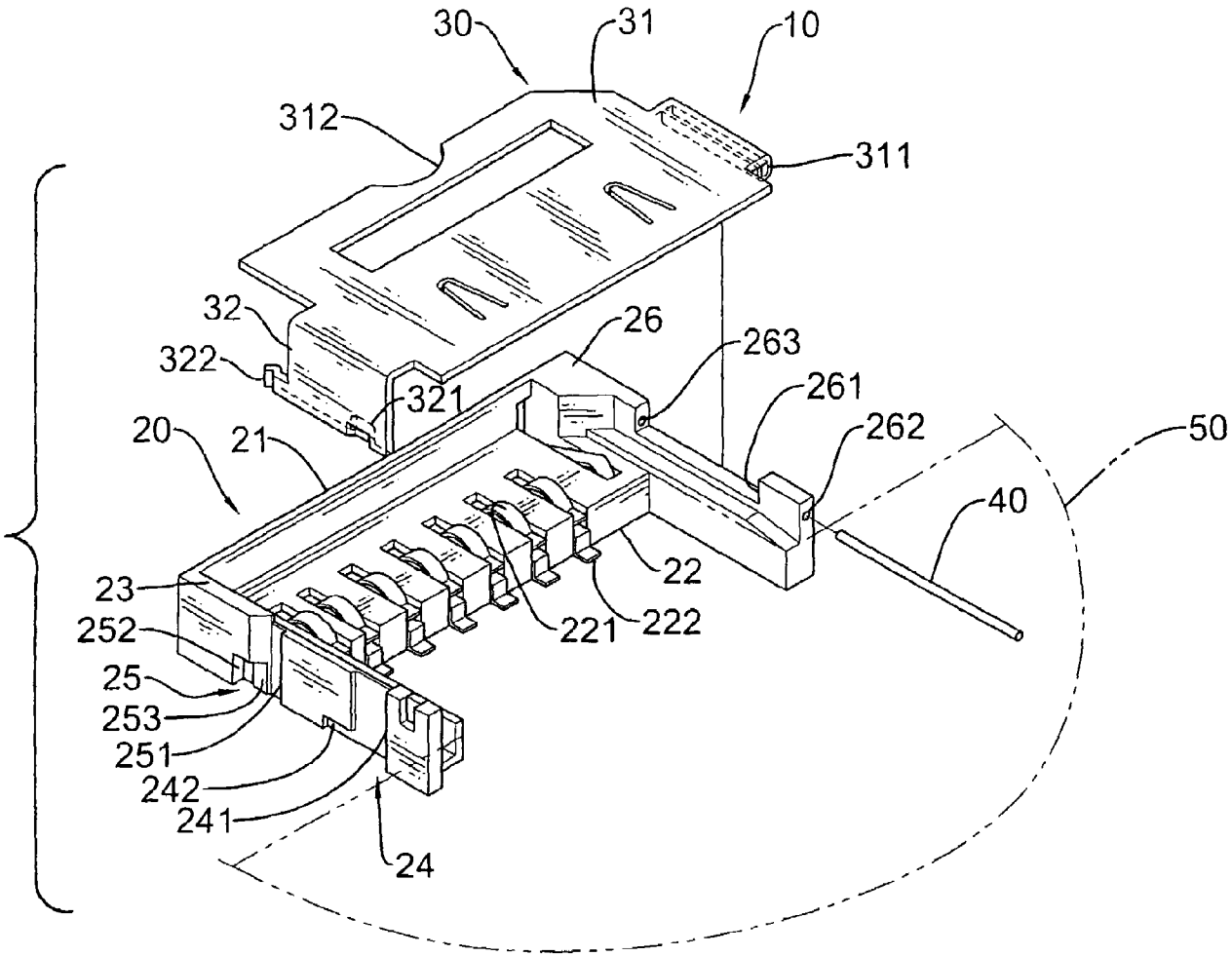
FIG. 1 is an exploded perspective view of a memory card connector in accordance with the present invention.
Figure 2:
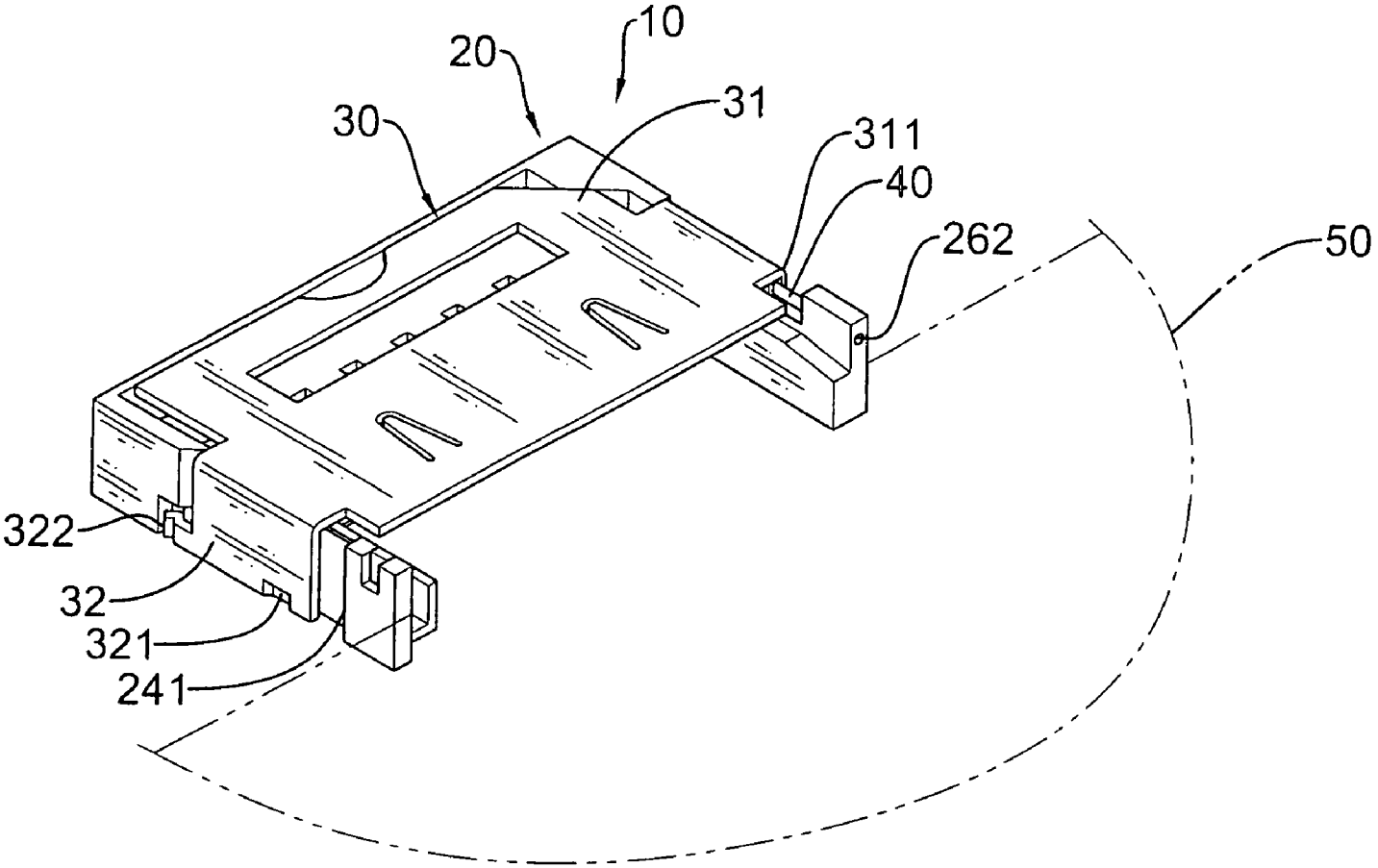
FIG. 2 is a perspective view of a memory card connector in accordance with the present invention.
Figure 3:
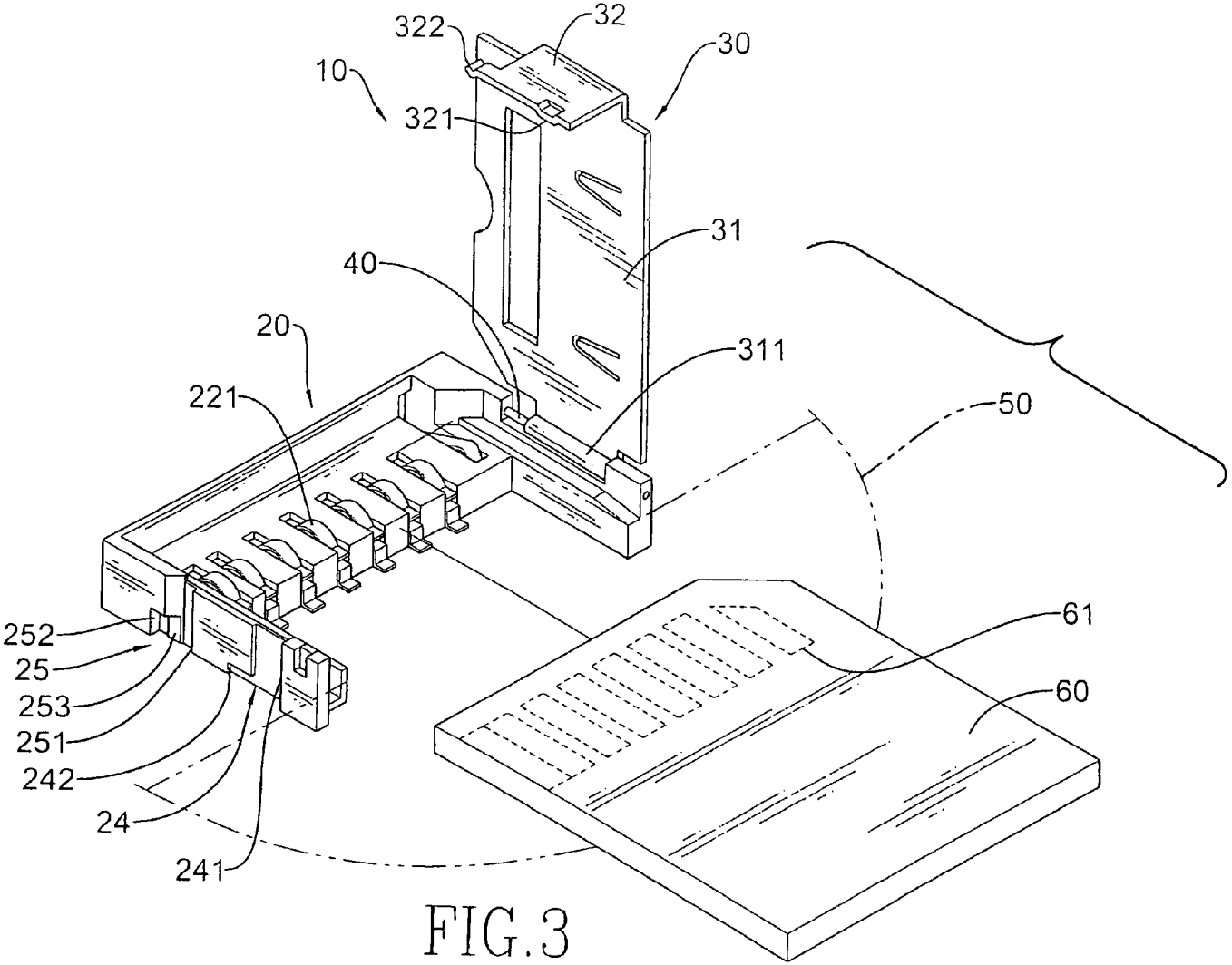
FIG. 3 is a perspective view showing that a pivotal cover of the memory card connector is opened for receiving a memory card.

With reference to FIGS. 1 to 3, a memory card connector (10) in accordance with the present invention is used to receive a memory card (60) with a plurality of fingers (61). The memory card connector (10) has a body (20) formed with a U-like shape and a cover (30) pivotally mounted on the body (20).

The body (20) is composed of a central portion (21) and two arms (23, 26) respectively at two opposed ends of the central portion (22) and substantially perpendicular to the central portion (22). Multiple contacts (221) are provided on a top surface of the central portion (21) for being electrically connected to the fingers (61) of the memory card (60).

Multiple terminals (222) are provided on a bottom surface (22) of the central portion (21) and respectively electrically connected to the contacts (221). The terminals (222) can be electrically connected to a circuit board (50) when the memory card connector (10) is installed in digital peripheral equipment.

At least one L-shaped slot is defined at the first arm (23). In this embodiment, a first slot (24) and a second slot (25) are separately defined at an exterior side of the first arm (23), wherein the first slot (24) is composed of a first upright channel (241) and a first lateral channel (242) communicated with the first upright channel (241), and the second slot (25) is composed of a second upright channel (251) and a second lateral channel (252) communicated with the second upright channel (251). A lug (253) is formed in the second lateral channel (252).

A notch (261) is defined in the second arm (26), and a first aperture (262) and a second aperture (263) are respectively defined at two opposed ends of the notch (261) and aligned with each other.

The cover (30) with an L-like cross section is composed of a lateral portion (31) and an upright portion (32) integrally formed with the lateral portion (31). A tubular part (311) is formed at a free end of the lateral portion (31) and opposed to the upright portion (32), and is pivotally mounted in the notch (261) by a pin (40) inserted through the apertures (262, 263) and the tubular part (311). A length of the tubular part (311) is shorter than a length of the notch (261), so the cover (30) can be slightly moved along the pin (40).

At least one stop is formed at an interior surface of the upright portion (32) and located in the corresponding L-shaped slot for locking the cover (30) on the body (20). In this embodiment, the upright portion (32) has a first stop (321) to correspond to the first L-shaped slot (24), and a second stop (322) formed at a distal end of the upright portion (32) to correspond to the second L-shaped slot (25).

Figure 4:
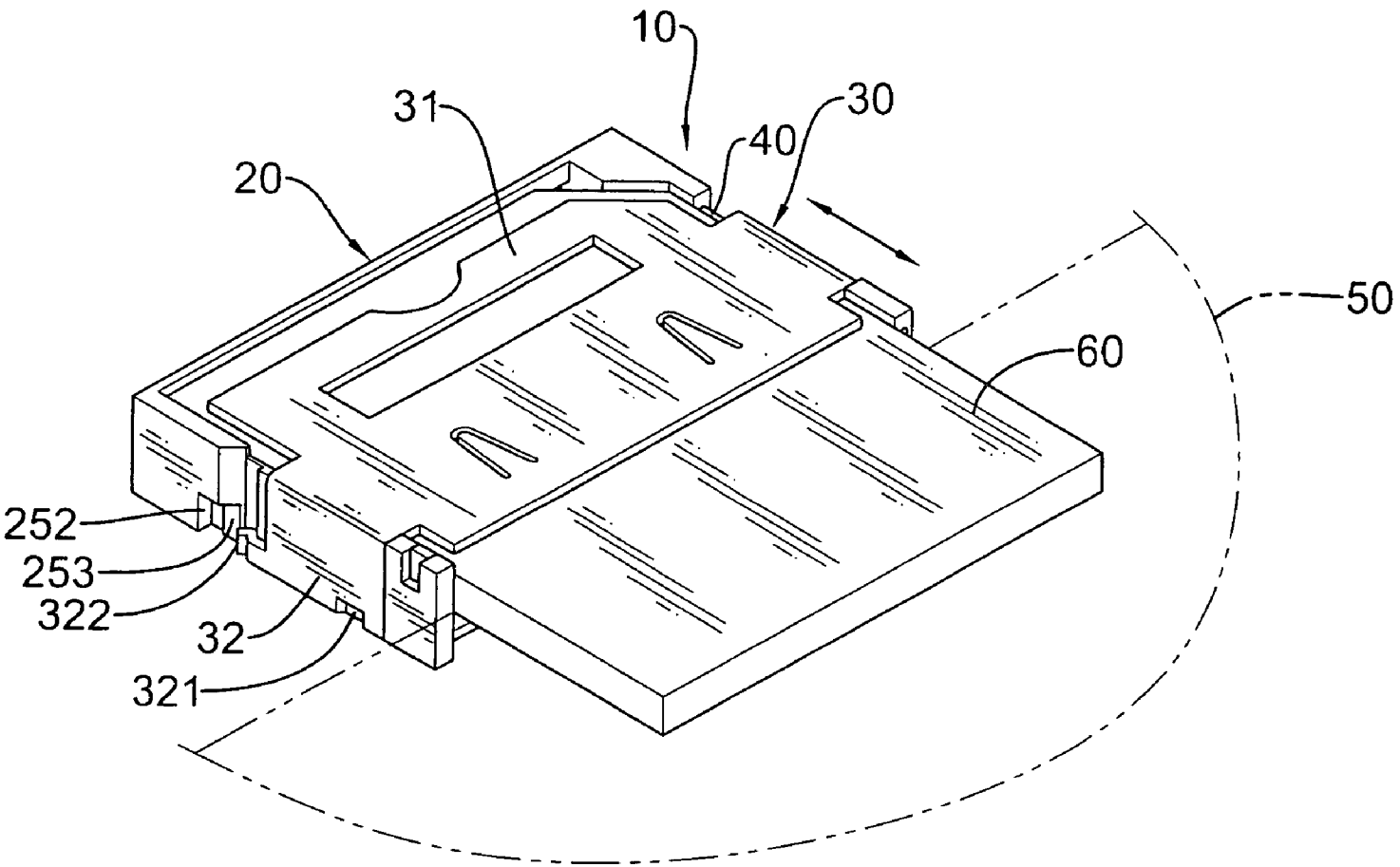
FIG. 4 is a perspective view showing that the memory card is received but the pivotal cover is not fastened.
Figure 5:
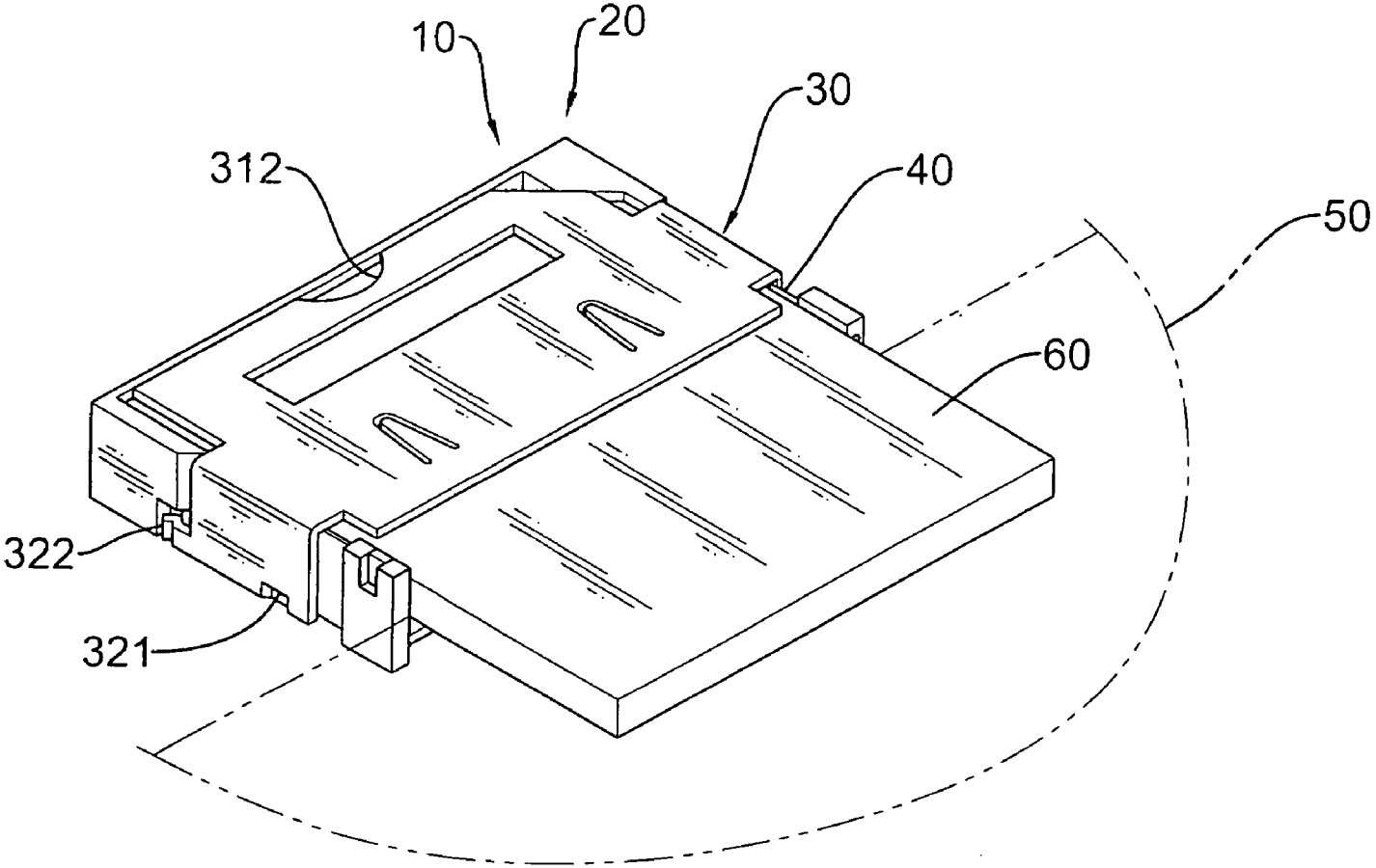
FIG. 5 is a perspective view showing that the pivotal cover is fastened to securely position the memory card in the memory card connector.

With reference to FIGS. 3, 4 and 5, in a status of the cover (30) being opened, a memory card (60) is inserted in the body (20). Thereafter, the cover (30) is pivoted downwards to abut the body (20), and the first and second stops (24, 25) are respectively located in the first and second upright channels (241, 251). Then, the lateral portion (31) of the cover (30) is horizontally moved along the pin (40) towards the central portion (21), so the stops (24, 25) are respectively entered into the lateral channels (242, 252) to prevent the cover (30) from pivoting. When the second stop (322) has entered the second lateral channel (252) and is obstructed by the lug (253), the second stop (322) can be deformed outwards to move over the lug (253), so the upright portion (32) is locked by the lug (253) and the cover (30) will not freely open. Thus, the memory card (60) is securely received in the memory card connector (10).

Furthermore, with reference back to FIG. 1, an arcuate notch (312) is defined at a side of the cover (30) adjacent to the central portion (21). A user can insert a finger or a tool into the arcuate notch (312) to move the cover (30) away from the central portion (21), so the stops (321, 322) are shifted from the lateral channels (242, 252) and the cover (30) can be pivoted upwards for removing the memory card (60).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A memory card connector comprising:

a body (20) with a U-like shape having a central portion (21) and a first arm (23) and a second arm (26) respectively formed at two opposed ends of the central portion (21) and substantially perpendicular to the central portion (21), wherein the central portion (21) has multiple contacts (221) mounted on a top surface for electrically connecting with fingers of a memory card, and multiple terminals (222) mounted at a bottom surface and respectively and electrically connected to the contacts (221) for electrically connecting with a circuit board, and the first arm (23) has a first L-shaped slot (24) defined at an exterior side and being composed of a first upright channel (241) and a first lateral channel (242) communicated with the first upright channel (241) and a second L-shaped slot (25) defined at the exterior side and being composed of a second upright channel (251) and a second lateral channel (252) communicated with the second upright channel (251); and a cover (30) with an L-like cross section having a lateral portion (31) and an upright portion (32) integrally formed with the lateral portion (13), wherein the lateral portion (31) has a free end pivotally mounted on the second arm (26) and longitudinally movable along the second arm (26), and the upright portion (32) has a first stop (321) and a second stop (322) formed at an interior side for being positioned in the first L-shaped slot (24) and the second L-shaped slot respectively, wherein the second arm (26) has a notch (261), and a first aperture (262) and a second aperture (263) respectively defined at two opposed ends of the notch (261) and aligned with each other; and the cover (30) has a tubular part (311) with a length shorter than that of the notch (261) formed at the free end and pivotally mounted in the notch (261) by a pin (40) extending through the first aperture (262), the tubular part (311) and the second aperture (263).

2. The memory card connector as claimed in claim 1, wherein the cover (30) has a second stop (322) formed at a distal end of the upright portion (32) for being engaged in the second L-shaped slot (25).

3. The memory card connector as claimed in claim 2, wherein the first arm (23) further has a lug (253) formed in the second lateral channel (252).

4. The memory card connector as claimed in claim 1, wherein the cover (30) has an arcuate notch (312) defined at a side adjacent to the central portion (21).

* * * * *